US006509527B2

(12) United States Patent
Gadessaud et al.

(10) Patent No.: US 6,509,527 B2
(45) Date of Patent: Jan. 21, 2003

(54) HIGH AND VERY HIGH VOLTAGE DC POWER CABLE

(75) Inventors: Robert Gadessaud, Palaiseau (FR); Bernard Aladenize, Epinay sur Orge (FR); Patrice Tran, Aubervilliers (FR); Hakim Janah, Coulogne (FR); Pierre Mirebeau, Villebon S/Yvette (FR); Daniel Acroute, Calais (FR)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/789,824

(22) Filed: Feb. 22, 2001

(65) Prior Publication Data

US 2001/0030053 A1 Oct. 18, 2001

(30) Foreign Application Priority Data

Feb. 24, 2000 (FR) ..... 00 02324

(51) Int. Cl.[7] ..... H01B 7/00
(52) U.S. Cl. ..... 174/120 R; 174/120 SC
(58) Field of Search ..... 174/110 R, 110 AR, 174/110 SR, 110 PM, 120 R, 120 C, 120 FP, 120 SC, 120 AR

(56) References Cited

U.S. PATENT DOCUMENTS 3,684,821 A * 8/1972 Miyauchi et al. ..... 174/120 SC
4,060,659 A * 11/1977 Matsubara et al. ..... 428/379
4,412,938 A * 11/1983 Kakizaki et al. ..... 252/511
4,470,898 A * 9/1984 Penneck et al. ..... 252/511
4,622,352 A * 11/1986 Djiauw et al. ..... 523/200
4,671,896 A * 6/1987 Hasegawa et al. ..... 106/18.11
4,876,147 A * 10/1989 Schlag et al. ..... 428/379
5,070,597 A * 12/1991 Holt et al. ..... 29/631
5,225,495 A * 7/1993 Han et al. ..... 525/327
5,304,326 A * 4/1994 Goto et al. ..... 252/511
5,416,155 A * 5/1995 Aladenize et al. ..... 524/495
5,561,185 A * 10/1996 Hashimoto et al. ..... 524/436
5,656,371 A * 8/1997 Kawahigashi et al. ..... 428/375
5,747,559 A * 5/1998 Whitehouse et al. ..... 523/205
5,889,117 A 3/1999 Flenniken et al.
5,994,450 A * 11/1999 Pearce ..... 524/505
6,197,848 B1 * 3/2001 Whitehouse et al. ..... 523/205

FOREIGN PATENT DOCUMENTS

EP 0 370 518 A2 5/1990
JP 2000-294038 A1 * 4/1999 ..... H01B/3/44

* cited by examiner

*Primary Examiner*—Dean A. Reichard
*Assistant Examiner*—William H. Mayo, III
(74) *Attorney, Agent, or Firm*—Sughrue Mion, PLLC

(57) ABSTRACT

The high or very high voltage DC cable has extruded polymeric insulation made out of a styrene-containing material. The material of the insulation is constituted by a mixture comprising polyethylene, a hydrogenated block copolymer of styrene, and an anti-oxiding agent, with the styrene content by mass being 11% to 18%, and the material is not cross-linked. The cable is suitable for use as a DC power cable.

6 Claims, 7 Drawing Sheets

HIGH AND VERY HIGH VOLTAGE DC POWER CABLE

The present invention relates to power cables for high and very high voltage DC.

BACKGROUND OF THE INVENTION

1. Field of the Invention

The cables to which the present invention applies are cables for 60 kilovolts (kV) to 600 kV or more, and preferably cables for 150 kV or more, operating with DC and having extruded polymeric insulation.

2. Description of the Related Art

Document JP-A-2-18811 discloses a DC power cable comprising a conductive core and extruded polymeric insulation surrounding the core. The insulation is constituted by a mixture of high density polyethylene, low density polyethylene, peroxide, and preferably carbon black in the form of fine particles, having 2% to 20% by weight high density polyethylene and 0.5% to 1.5% by weight of carbon black, and it is cross-linked. The insulation is intended to improve the breakdown characteristics under a DC voltage and under a surge voltage, in particular due to a lightning strike on the cable, compared with the same characteristics for an analogous cable in which the insulation has only one type of polyethylene.

The small quantity of carbon black incorporated in the insulation of that known cable minimizes the risks of breakdown due to defects in the insulation. It gives rise to dielectric losses in the insulation of the DC cable, which losses are of little importance in the absence of defects and when the electric field is weak, but they become excessive and unacceptable when defects are present and the electric field is strong.

Document EP-A-0 539 905 discloses a high voltage DC cable in which the insulating material is made of a thermoplastic rubber having an elastomeric phase and a thermoplastic phase. In a first embodiment of that cable, the thermoplastic rubber can be of the olefin type. In which case, the elastomeric phase is constituted by an ethylene-propylene rubber and the thermoplastic phase is selected from polyethylene and polypropylene. In a second embodiment, the thermoplastic rubber can be of the styrene type. In which case, the elastomeric phase can be hydrogenated and selected from polybudadiene and polyisoprene, and the thermoplastic phase can be constituted by polystyrene. The insulation of that known cable makes it possible to reduce the phenomenon whereby space charge accumulates in the presence of high voltage DC.

OBJECTS AND SUMMARY OF THE INVENTION

An object of the present invention is to make a high and very high voltage DC cable that avoids dielectric losses in the insulation and that presents simultaneously optimized characteristics for withstanding breakdown under a DC voltage and avoiding breakdown under a surge impulse voltage, for a high working voltage and with a quantity of space charge that is minimized in the presence of high voltage DC, so as to provide a cable of very good reliability.

The invention provides a high or very high voltage DC cable comprising a conductive core and extruded polymeric insulation made of a styrene-containing material, wherein said material is constituted by a mixture of polyethylene, a hydrogenated block copolymer of styrene selected from copolymers of styrene and butadiene and of styrene and isoprene, present at a styrene content by mass lying in the range 11% to 18%, and it is not cross-linked.

By means of this insulation, the working voltage under steady conditions is particularly high and simultaneously the risk of breakdown is made very low, thereby increasing reliability of the cable.

Advantageously, the mass concentration of styrene in said mixture is selected to lie in the range 11.5% to 16%.

According to an additional feature, said cable includes an inner semiconductive screen between said conductive core and said insulation, and an outer semiconductive screen around said insulation, both screens being constituted by a polymeric matrix which is selected to be of the same nature as said insulation, which contains a conductive filler, and which is not cross-linked.

BRIEF DESCRIPTION OF THE DRAWINGS

The characteristics and advantages of the present invention appear further from the following description of an embodiment of a cable of the invention which is shown by way of non-limiting illustration in the accompanying drawings, and from the description of the properties of the insulating material of the cable.

In the drawings.

MORE DETAILED DESCRIPTION

Figure 1:
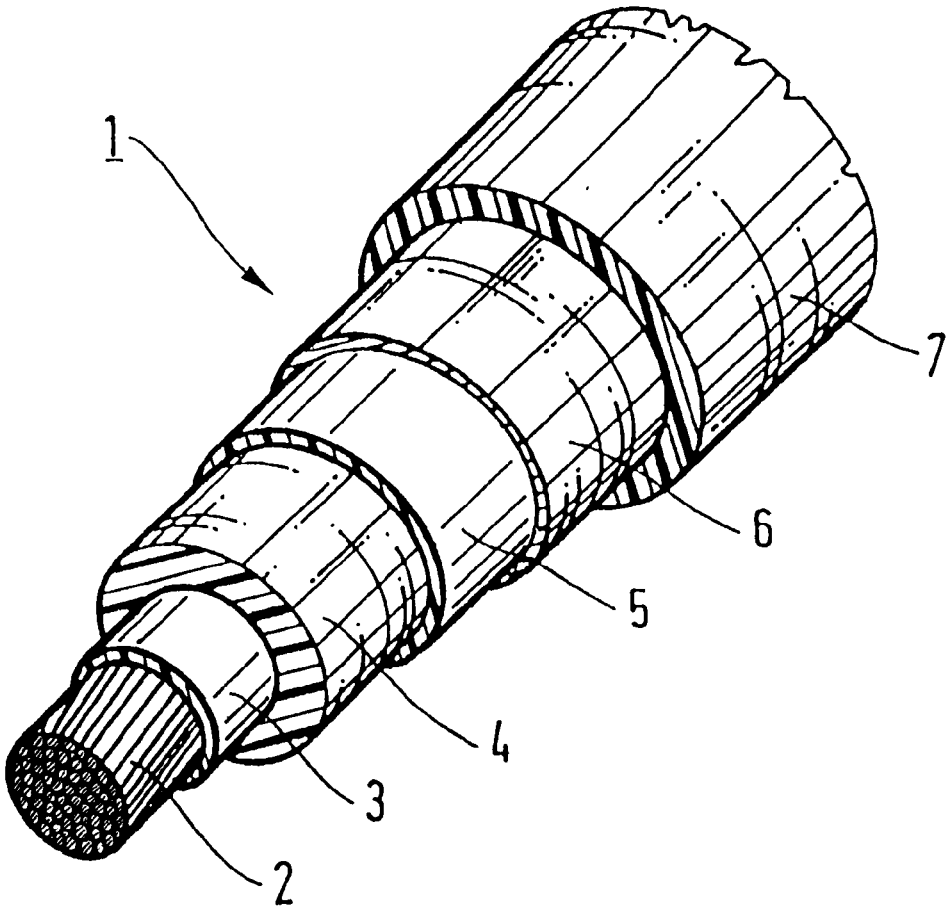
FIG. 1 is a cutaway perspective view of a high or very high voltage DC cable of the invention.

The high or very high voltage DC power cable 1 shown in FIG. 1 comprises a central conductive core 2 and in succession and coaxially around said core: an inner semiconductive screen 3; insulation 4; an outer semiconductive screen 5; a metal protective screen 6; and an outer protective sheet 7.

The presence of the screens 3, 5, and 6 is preferred. The insulation 4 is made in accordance with the invention. Advantageously, the semiconductive screens 3 and 4 are also made in accordance with the present invention.

The protective structure which comprises the metal screen 6 and the outer sheath can also have other protective elements, and in particular a protective strip (not shown) that inflates in the presence of water and that is optionally semiconductive. Such a protective strip is preferably interposed between the outer semiconductive screen and the metal screen. On its own or in association with conductor means it provides electrical continuity between the outer semiconductive screen and the metal screen. The protective structure of the cable is of conventional type and lies outside the context of the present invention.

In the present invention, the insulation 4 of the cable 1 is made up of a mixture comprising polyethylene, a hydrogenated block copolymer of styrene, and an anti-oxidizing agent, with the mass content of styrene lying in the range 11% to 18%, and it is not cross-linked.

The polyethylene used is selected from low and/or medium and/or high density polyethylenes. The hydrogenated block copolymer is selected from copolymers of styrene and butadiene and of styrene and isoprene. It is preferably a hydrogenated block terpolymer.

As discovered by the Applicant and as revealed by the comparative test results described below, the 11% to 18% content of styrene in the mixture makes it possible, surprisingly, to obtain characteristics of withstanding breakdown under DC voltage and breakdown under voltage surges due to lightning striking a conversion station connected to the cable or striking one of the ends of the cable, which characteristics are optimized so as to make it possible to use a high working voltage. Simultaneously, this styrene content makes it possible to minimize the quantity of space charge in the insulation of the cable under DC voltage, thereby considerably reducing the risks of breakdown.

This mass content of styrene in the mixture lies preferably in the range 11.5% to 16%.

With reference to the tests that have been performed by the Applicant and whose results are given below, it is stated that the various samples used were constituted by a mixture comprising low density polyethylene and a hydrogenated block terpolymer of styrene-butadiene styrene. The mass content of styrene differed between samples. All the samples had the same thickness. The mixture was not cross-linked, thereby avoiding the presence of cross-linking by-products that lead to an increase in space charge density.

TABLE 1

| Styrene % by weight | Vimp kV/mm | Vcc kV/mm | Vo (r = 1.4) kV/mm | Vo (r = 1.1) kv/mm |
|---|---|---|---|---|
| 0 | 223 | 146 | 146 | 146 |
| 1 | 218 | 178 | 156 | 178 |
| 5 | 203 | 225 | 145 | 185 |
| 10 | 137 | 336 | 98 | 125 |
| 12 | 231 | 323 | 165 | 210 |
| 15 | 219 | 295 | 156 | 199 |

In Table 1, Vimp is the breakdown voltage under surge conditions and Vcc is the breakdown voltage under steady conditions for samples at 70° C., and Vo is the working voltage gradient that is acceptable under steady conditions, expressed in kilovolts per millimeter (kV/mm) depending on the styrene mass content of the samples.

Figure 2:
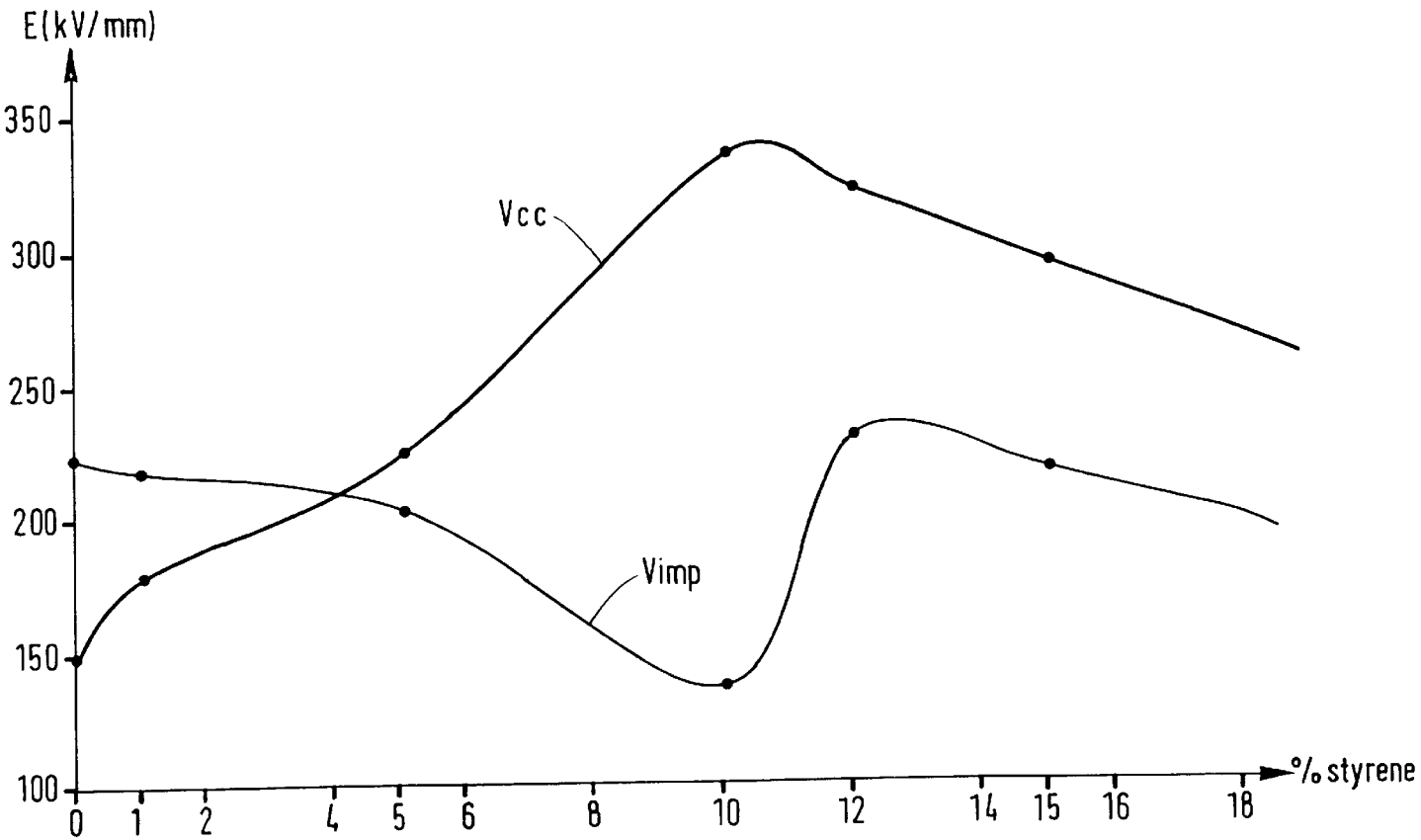
FIG. 2 is a graph showing breakdown characteristics relative to a lightning surge voltage and to a DC voltage, as a function of the insulating system of the cable.

The way Vimp and Vcc vary as a function of the styrene content is shown in FIG. 2. It can be seen that the steady breakdown voltage Vcc is relatively low at 0% styrene content, increases steeply for styrene contents up to 10%, and then decreases only very gently while remaining very high for styrene contents lying in the range 10% to 15% and beyond up to a content limit set by the maximum that can easily be incorporated. In parallel, the surge breakdown voltage Vimp is relatively high for 0% styrene and then decreases very quickly for increasing styrene content up to 10%, but thereafter increases very sharply and in a most surprising manner beyond 10% up to the maximum content that can easily be incorporated.

This content limit determined by ease of incorporation is presently about 18% to 20% styrene in the mixture. At this limiting content, the Applicant has been able to perform incomplete testing only because of reasons associated with the duration of some of the tests, and so the characteristics of those samples are therefore not given.

These two breakdown characteristics Vimp and Vcc make it possible to evaluate the working voltage gradient under steady conditions that can be withstood by the samples and constitutes the characteristic for dimensioning for the insulating system constituted by said mixture for a DC cable.

The working voltage gradient Vo is firstly a result of the breakdown voltages Vimp and Vcc and also of the fact that a DC cable can be subjected to lightning surge stresses which are greater than its steady DC voltage stresses. At present, it is accepted that the surge stresses which a DC cable must be capable of withstanding are about 1.4 times greater the steady DC voltage stresses, this taking account of the improvements to the available surge limiter circuits that are now used, such as those including zinc oxide varistors. This ratio, written r, can be brought down to 1.1 in the light of the improvements to such limiters in association with the increased reliability in the breakdown resistance provided by the insulation itself, which in the present case is explained in greater detail below.

Figure 3:
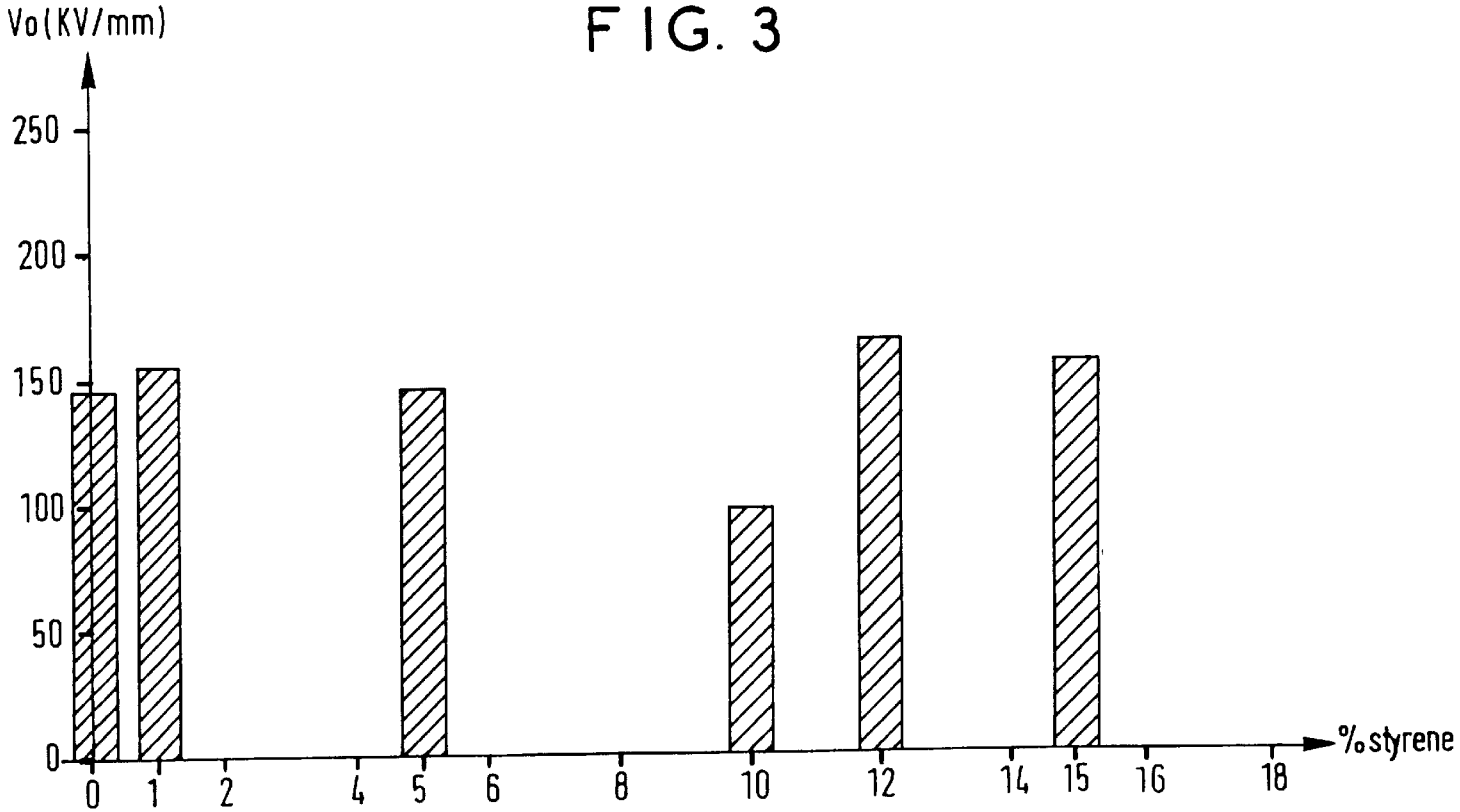
FIGS. 3 and 4 are bar charts showing the working voltage gradient that is acceptable as a function of said insulation system.
Figure 4:
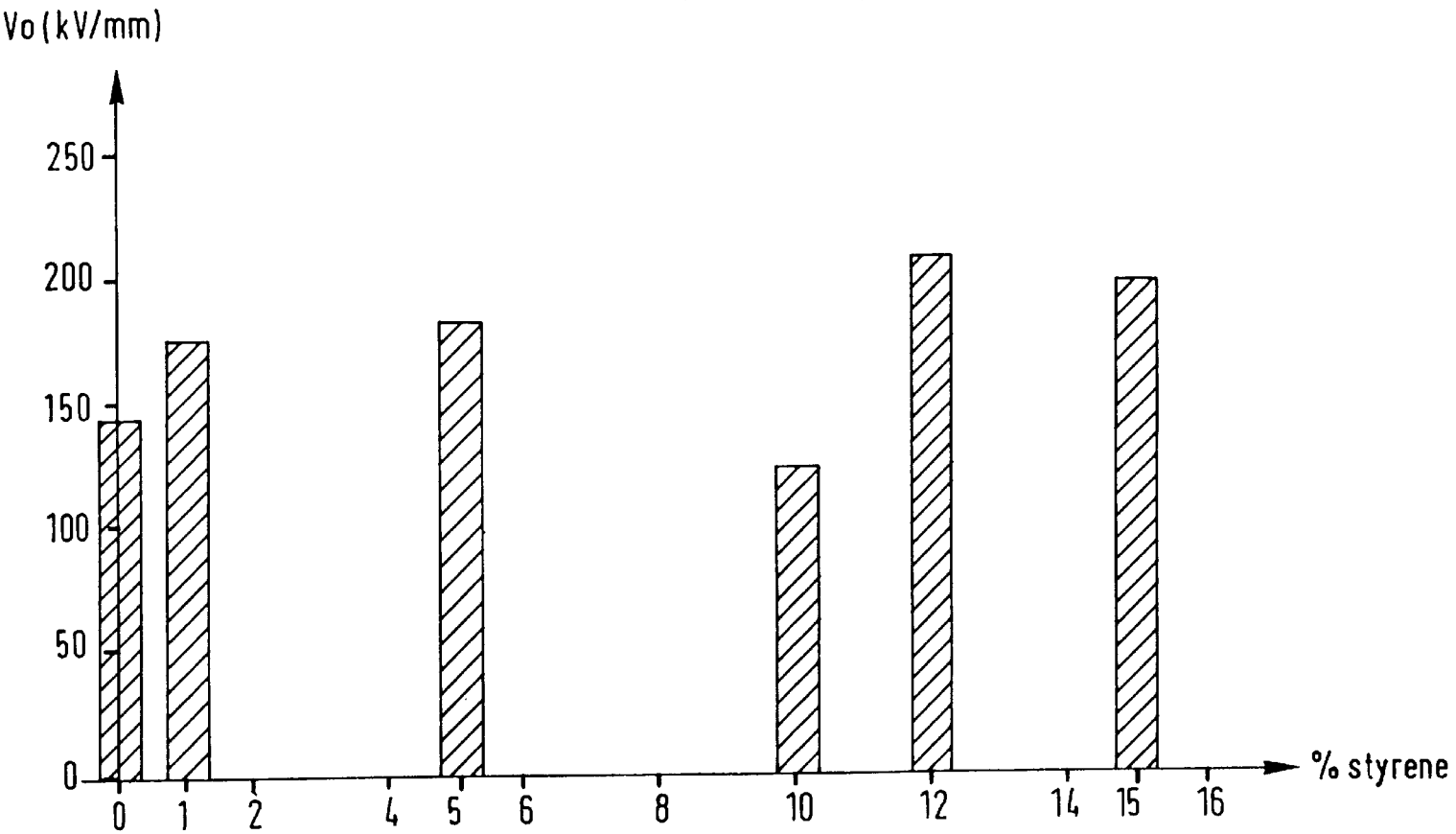

For each of the samples considered, the acceptable working voltage gradient Vo was determined as the lower of the two values Vimp/r and Vcc. It is given in Table 1 for r=1.4 and for r=1.1 as a function of styrene content and it is shown graphically for r=1.4 in FIG. 3 and for r=1.1 in FIG. 4, likewise as a function of styrene content.

From these acceptable values of working voltage gradient Vo depending on the styrene content in the mixture used, it can be seen that a styrene content lying in the range 11% to 18%, and preferably in the range 11.5% to 16% leads to a working voltage gradient having a value that is very high and that is improved.

In this respect, it should be observed that it is the surge performance that puts a limit on the working voltage gradient for styrene contents lying in the range 11% to 18%, but the invention specifically takes advantage of this surge performance (Vimp) suddenly becoming excellent for styrene contents lying in the range 11% to 18%.

The advantage of such a styrene content in the mixture used has been demonstrated in other ways by the Applicant. It has been found that the quantity of space charge created and trapped in the samples in the presence of a steady DC voltage and/or a temperature gradient decreases with increasing styrene content.

In addition, the maximum electric field under nominal operating conditions, i.e. while the cable is carrying direct current, decreases and becomes low for such styrene contents in the mixture. This leads to lower stresses being applied to the cable.

In addition, at these styrene contents, the trapped space charge becomes less harmful and leads only very occasionally to sudden co-operative breakdown of trapping, which gives rise to breakdown under DC voltage then being very unlikely.

These features lower the risks of breakdown, i.e. considerably increase the reliability and the expected lifetime of the cable, and mean that the exceptional dielectric properties of the insulation made in this way are maintained in the long term.

In comparison, such dielectric properties are not achieved and degrade over time for styrene contents of less than 10%, where the effect of space charge is greater, giving rise to breakdowns that are more frequent.

The performance obtained by using the insulation of the present invention is further improved by also using inner and outer semiconductive screens made using a polymeric matrix having the same nature as said insulation.

This matrix for the semiconductive screens is constituted by a mixture of polyethylene, of a hydrogenated block copolymer of styrene, and of an anti-oxidizing agent, in which a conductive filler is incorporated in order to obtain the desired electrical resistance and mechanical and rheological properties. This ensures chemical and electrical compatibility between the insulating material and the semiconductive screens at the interfaces between them. This also further reduces space charge in the insulation and electric field intensity at the interfaces, by improving the behavior of the cable under DC voltage and under lightning surges. The matrices of the semiconductive screens are not cross-linked for the same reasons as given above with respect to the insulation.

The conductive filler is carbon black or preferably acetylene black.

The styrene content of the polymeric matrices of the semiconductive screens is less critical than in the insulation, because of the presence of the conductive filler incorporated in these matrices. These matrices can contain 0.1% to 20% styrene. The preferred content lies in the range 1% to 10%.

Figure 5:
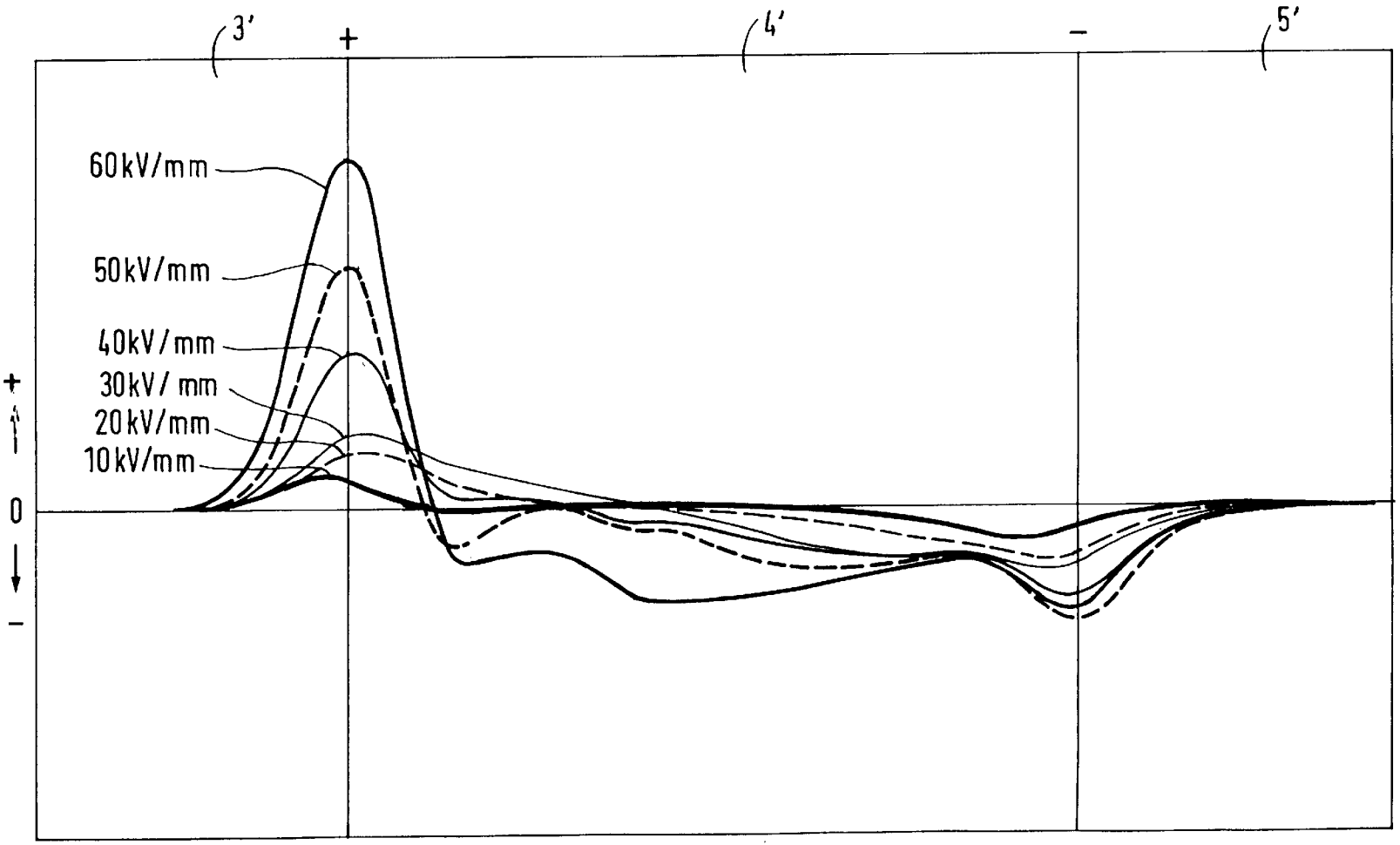
FIG. 5 is a graph showing the quantities of space charge in a conventional insulating system for different values of potential gradient applied to the system.
Figure 6:
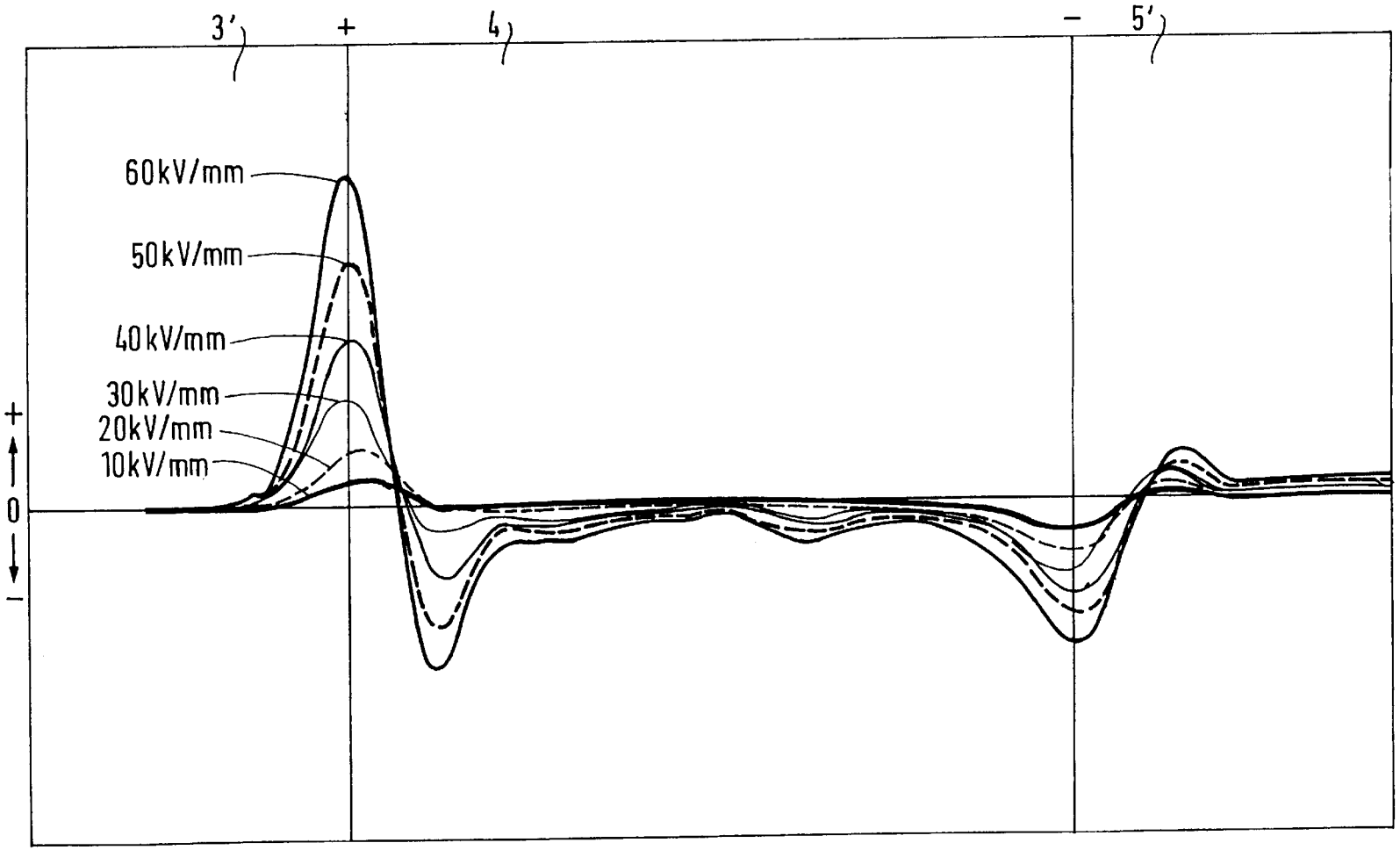
FIGS. 6 and 7 show the quantities of space charge present in insulating systems of the invention for the same values of potential gradient as in FIG. 5.
Figure 7:
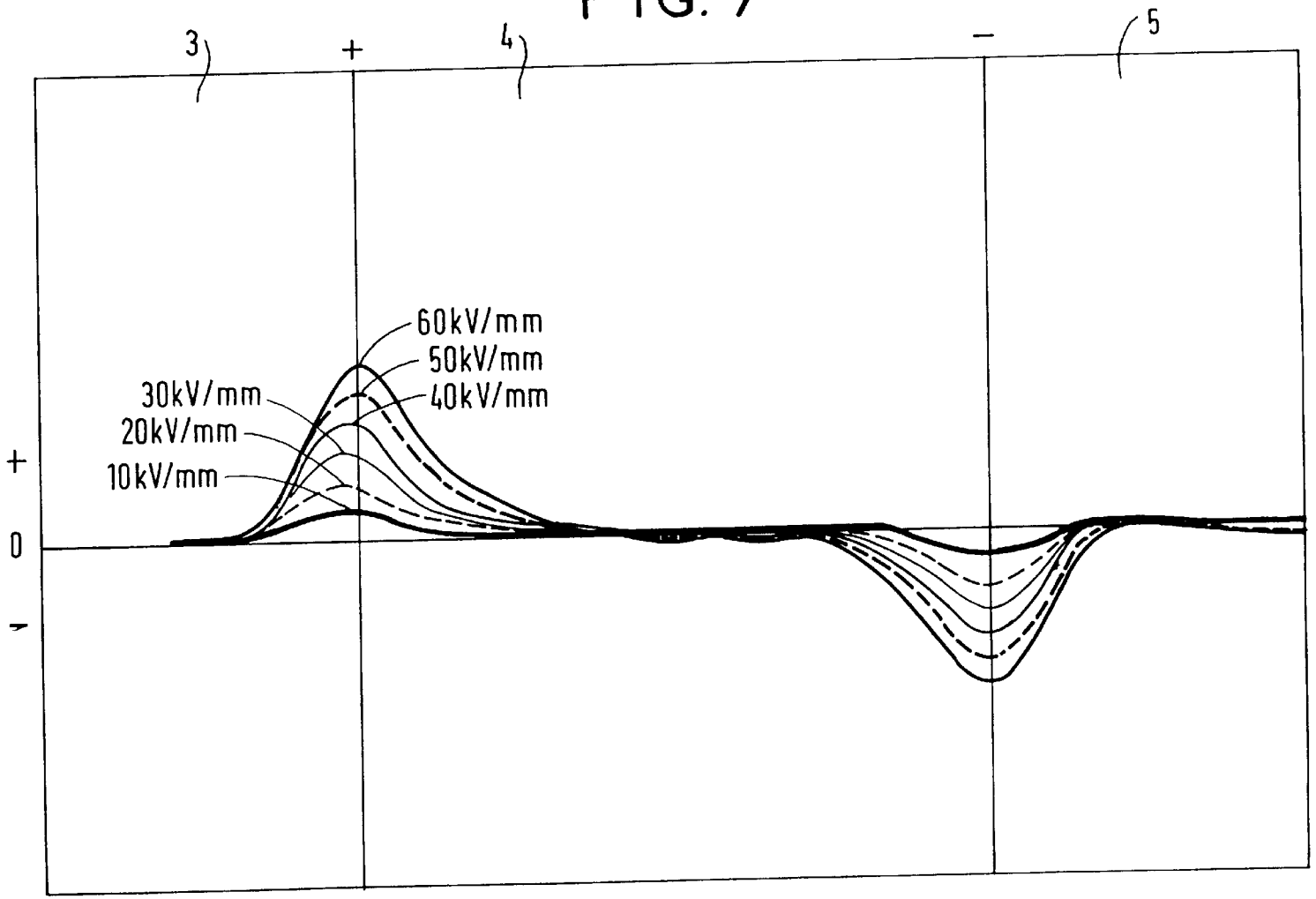

The space charge measurements shown in FIGS. 5, 6, and 7 were taken using a pulsed electroacoustic (PEA) method that is, itself, conventional. The measurements were taken on a plane sample of the insulating system concerned, constituted by an insulating layer having a thickness of 0.5 mm and two semiconductive layers having thickness of 0.2 mm to 0.3 mm situated on opposite sides of the insulating layer, with a potential difference being applied between the semiconductive layers.

Thus, a potential difference of 5 kV, 10 kV, . . . , 30 kV applied between the semiconductive layers gave rise to a mean potential gradient of 10 kV/mm, 20 kV/mm, . . . , 60 kV/mm in the insulating system, the local potential gradient being a function of the quantity of space charge in the material.

In FIG. 5, references 3' and 5' designate the two semiconductive layers and 4' designates the insulating layer of a conventional insulating system. In FIG. 6, the insulating system of the invention has an insulating layer 4 of the invention and conventional semiconductive layers 3' and 5'. In FIG. 7, the preferred insulating system of the invention has an insulating layer 4 and semiconductive layers 3 and 5 which are all in accordance with the present invention.

In these three figures, the potential difference as applied is represented by the signs + and − at the interfaces between the various layers of the insulating system. The signs + and − on either side of zero are also used to show the positive and the negative space charges measured in Coulombs per cubic meter ($C/m^3$) without specifying the corresponding scale which is not certain in terms of absolute value but which is analogous for all of the curves shown.

The curves of FIG. 5 show that the insulating layer 4' of the conventional insulating system contains large amounts of space charge throughout its thickness. The quantities of space charge increase with increasing voltage gradient.

In comparison, the curves of FIG. 6 show that the space charge in the insulating layer 4 using the insulating system of the invention is restricted to the vicinity of the interfaces with the conventional semiconductive layers 3' and 5' and practically non-existent elsewhere. The behavior of the insulating system is thus improved compared with the behavior of the preceding, conventional system.

Also comparatively, the curves in FIG. 7 show that the space charge in the insulating layer 4 of the preferred insulating system of the invention is likewise restricted to the vicinity of the interfaces with the semiconductive layers of the invention, but in addition the amount of charge is considerably reduced and has the same sign as the charge contained in the interface semiconductive layer. This low level of space charge and identity of sign on either side of the interface gives rise to an electric field that is minimized, for which this preferred insulating system is believed to be optimal.

What is claimed is:

1. A high or very high voltage DC power cable comprising a conductive core and extruded polymeric insulation made of a styrene-containing material, wherein said material of said insulation is constituted by a mixture comprising polyethylene, a hydrogenated block copolymer of styrene selected from copolymers of styrene and butadiene and of styrene and isoprene, and an anti-oxidizing agent, with a styrene content by mass lying in the range of 11% to 18%, and it is not cross-linked.

2. A cable according to claim 1, wherein said mixture has a styrene content lying in the range 11.5% to 16%.

3. A cable according to claim 1, wherein said hydrogenated block copolymer of styrene is a block terpolymer.

4. A cable according to claim 1, comprising an inner semiconductive screen between said insulation and said conductive core, and an outer semiconductive screen surrounding said insulation, both screens being constituted by a polymeric matrix which is selected to be of the same nature as said insulation, which contains a conductive filler, and which is not cross-linked.

5. A cable according to claim 4, wherein said polymeric matrix contains a styrene content by mass lying in the range 0.1% to 20%.

6. A cable according to claim 5, wherein said polymeric matrix contains a styrene content by mass lying in the range 1% to 10%.

* * * * *